US010905177B2

(12) United States Patent
Iriarte Tineo

(10) Patent No.: US 10,905,177 B2
(45) Date of Patent: Feb. 2, 2021

(54) SYSTEMS AND METHODS FOR SUIT WITH PROTECTIVE MATERIAL

(71) Applicant: Juan Sebastian Iriarte Tineo, La Paz (BO)

(72) Inventor: Juan Sebastian Iriarte Tineo, La Paz (BO)

( * ) Notice: Subject to any disclaimer, the term of this patent is extended or adjusted under 35 U.S.C. 154(b) by 82 days.

(21) Appl. No.: 16/402,093

(22) Filed: May 2, 2019

(65) Prior Publication Data

US 2020/0345085 A1 Nov. 5, 2020

(51) Int. Cl.
*A41D 13/00* (2006.01)
*A41D 27/28* (2006.01)

(52) U.S. Cl.
CPC ..... *A41D 13/001* (2013.01); *A41D 27/28* (2013.01)

(58) Field of Classification Search
CPC ..... A41D 13/001; A41D 27/28; A41D 31/02; A41D 31/04; A41D 31/145; A41D 31/285; A41D 2500/20; A41D 13/00; A41D 13/0002; A41D 13/0005; A41D 13/02; A41D 13/0158; A41D 13/015; A41D 3/00
USPC ..... 2/4
See application file for complete search history.

(56) References Cited

U.S. PATENT DOCUMENTS 2,472,033 A 5/1949 Wetzel
3,213,465 A 10/1965 Ludwikowski
3,296,626 A 1/1967 Ludwikowski
3,721,997 A 3/1973 Mundt
4,685,152 A 8/1987 Heare
4,716,594 A * 1/1988 Shannon ..... A41D 13/001 2/4
4,985,933 A 1/1991 Lemoine
5,005,215 A 4/1991 McIlquham
5,035,006 A 7/1991 Hetz et al.
5,060,458 A 10/1991 Curtis
5,072,454 A 12/1991 Trahan
5,088,116 A 2/1992 Gould
5,119,510 A 6/1992 Schilling
5,243,706 A * 9/1993 Frim ..... A41D 13/0025 2/455
5,249,307 A * 10/1993 Lemoine ..... A41D 13/001 2/4

(Continued)

FOREIGN PATENT DOCUMENTS

GB 428063 A * 5/1935 ..... A41D 31/02
JP 07102401 A * 4/1995 ..... A41D 13/001
WO 2013009769 1/2013

*Primary Examiner* — Amy Vanatta
(74) *Attorney, Agent, or Firm* — Cionca IP Law P.C.; Marin Cionca

(57) ABSTRACT

A repellent suit constructed from a protective material, the suit having: a shirt portion; and a pants portion; a plurality of seams; the protective material having a plurality of layers joined together via bias tape, the plurality of layers having: a first net layer; a second net layer; and a three-dimensional mesh layer between the first net layer and the second net layer, the three-dimensional mesh layer having a first mesh sheet and a second mesh sheet raised to a first height above the first mesh sheet; wherein the first mesh sheet and the second mesh sheet are associated together via a plurality of compressible elements; wherein the bias tape provided at each seam of the plurality of seams is sewn onto the first net layer, the three-dimensional mesh layer, and the second net layer.

20 Claims, 4 Drawing Sheets

(56) References Cited

U.S. PATENT DOCUMENTS 5,293,646 A 3/1994 Winston
RE34,662 E 7/1994 Keller
5,341,511 A * 8/1994 Wells ..... A41D 13/001 2/1
5,357,635 A * 10/1994 Lemoine ..... A41D 13/001 2/173
5,359,963 A 11/1994 Jesse, Jr. et al.
5,526,532 A 6/1996 Willard
5,551,091 A 9/1996 Tyndall
5,600,850 A * 2/1997 Shannon ..... A41D 13/001 2/4
5,701,892 A 12/1997 Bledstein
6,263,511 B1 * 7/2001 Moretti ..... A41D 31/102 2/97
6,477,711 B1 11/2002 Freeman et al.
6,481,383 B1 11/2002 Ross et al.
6,589,891 B1 7/2003 Rast
6,662,754 B1 12/2003 Wilson
7,043,767 B2 * 5/2006 Jaeger ..... A41D 27/28 2/87
D756,602 S 5/2016 Darmour
D757,398 S 5/2016 Ingram
D758,698 S 6/2016 Darmour
D762,048 S 7/2016 Lomax
D762,346 S 8/2016 Lomax
D764,763 S 8/2016 Criss
D767,853 S 10/2016 Criss
D767,854 S 10/2016 Trullinger et al.
D770,136 S 11/2016 Darmour
D775,788 S 1/2017 Darmour
D778,033 S 2/2017 Darmour
D781,027 S 3/2017 Zheng
D790,809 S 7/2017 Lomax
2001/0052141 A1 12/2001 Andersen
2002/0124293 A1 * 9/2002 Zeiler ..... A41D 13/001 2/4
2005/0278837 A1 * 12/2005 Wallerstein ..... A41D 13/001 2/456
2006/0009101 A1 * 1/2006 Chou ..... A41D 13/001 442/59
2006/0048291 A1 3/2006 Sims
2009/0178174 A1 7/2009 Cash et al.
2012/0005812 A1 1/2012 Corzatti
2012/0141756 A1 * 6/2012 Ramaioli ..... B32B 5/02 428/213
2013/0125287 A1 5/2013 Boyle
2013/0232676 A1 9/2013 Corzatt
2013/0276201 A1 10/2013 Pezzimenti

* cited by examiner

SYSTEMS AND METHODS FOR SUIT WITH PROTECTIVE MATERIAL

BACKGROUND OF INVENTION

1. Field of the Invention

The invention relates generally to methods of pest repellent and more particularly to a full body suit constructed from a protective material which can protect a user from small invertebrates or other pests without the use of harmful chemicals.

2. Description of the Related Art

Many people may expose themselves daily to a number of diseases, such as Zika, rabies, malaria, and so on, via the vectors of such diseases, which may include small animals and invertebrates. The risk of exposure to diseases transmitted by insects or other vectors can be high in areas with warm to hot and/or rainy climates. Thus, many people who work outside and/or enjoy outdoor activities can be at a high risk of contracting a disease, some of which may be fatal. In addition to the dangers of disease, pests and poisonous plants can cause a variety of problems to people from minor annoyances and irritation to severe pain.

Harsh chemical repellents currently on the market for repelling disease-carrying animals and insects can pose several problems, such as specifically targeting a certain type of pest and thus being unable to repel all types of pests. Chemical repellents can become expensive because they can decrease in efficacy after a period of time after initial application and must be reapplied. This can require a user to frequently repurchase the repellent, which can be a strain on finances, as well as resources used to manufacture the product. Additionally, a user may not be aware that the effectiveness of a chemical repellent has diminished or disappeared, during which time a pest could bite and infect the user with a disease. Chemical repellents may not be effective underwater or against small animals. Chemical repellents can be an irritant or an allergen to some people, rendering them unusable for such people, or may have adverse side effects or health risks on some users. Additionally, physical barrier repellents may also pose several problems. As an example, a physical barrier can be in the form of netting or mesh worn around the face or placed around a bed at night. However, for users who need to be protected while being active cannot use netting designed to be placed around a bed or sleeping bag. Additionally, the netting as known in the art may be unusable during certain outdoor activities, as swimming, heavy outdoor labor, and so on, because it may also cause mobility issues to a user, restrict their movement, or may be easily torn while the user is being active. As another example, heavy clothing that could provide a barrier against pests may be too thick to use in hot weather and may thus be uncomfortable or lead to overheating for the user. Thus, there is a need for a solution to these problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a protective suit may comprise a shirt portion and a pants portion, both constructed out of a protective material. The protective material may have a layered design and may be constructed out of three layers, as an example. The three layers may be a net layer, a mesh layer, and a comfort fabric layer. The three layers may serve specific functions, i.e., the net layer can prevent small animals and invertebrates from crawling inside a person's clothing, the mesh layer may have a three-dimensional construction and may maintain a certain amount of space between a person's skin and the outermost layer of clothing, and the comfort fabric layer may prevent a person's skin from being irritated by a potentially rough mesh layer and also provide another layer of defense between a user's skin and pests. Thus, an advantage is that the protective material can help to minimize or reduce the risk of diseases transmitted by small animals, invertebrates, and other pests, and help to minimize or reduce exposure to poisons or toxins, by providing a physical barrier between the user and the harmful pests. Another advantage is that the protective suit may cover a large part of a user's body or the user's entire body such that exposure to pests or other harmful materials such as irritants or harmful plants or damaging materials can be reduced or eliminated. Another advantage is that the elasticity of the protective material may provide a degree of shock absorbance, thus reducing harm or discomfort to the user. Another advantage may be that the thickness of the mesh layer may help to prevent any pests, plants, irritants, or other harmful objects from physically reaching the skin of the user. Another advantage may be that the first net layer may provide the repellent suit with the appearance of typical or standard clothing as known in the art, which may improve the ease of use of the repellent suit to the user.

In another aspect, a repellent suit constructed from a protective material is provided, the suit comprising: a shirt portion having: a left sleeve; a right sleeve; a collar; a torso portion; and a front shirt portion closure; a pants portion having: a left leg; a right leg; a waist portion; and a front pants portion closure; a plurality of seams connecting the left sleeve, the right sleeve, the collar, and the front closure to the torso portion, and connecting the left leg, the right leg, and the front pants portion closure to the waist portion; bias tape at the plurality of seams; and thread sewing the bias tape to the plurality of seams; the protective material comprising: a plurality of layers; and a plurality of outer edges; the plurality of layers being breathable, and being joined together via the bias tape along the plurality of outer edges, and the plurality of layers comprising: a first net layer; a second net layer; and a three-dimensional mesh layer between the first net layer and the second net layer, the three-dimensional mesh layer comprising a first mesh sheet and a second mesh sheet raised to a first height above the first mesh sheet; wherein the first mesh sheet and the second mesh sheet are associated together via a plurality of compressible elements such that a force exerted on the second mesh sheet causes the second mesh sheet to be pressed towards the first mesh sheet at a second height smaller than the first height; wherein the plurality of seams occur on biases of each layer of the plurality of layers; wherein the bias tape provided at each seam of the plurality of seams is sewn onto the plurality of layers, such that the bias tape is bound to each layer of the plurality of layers via the thread passing through the bias tape and each layer of the plurality of layers, and such that the bias tape joins a first portion of an outer edge of the plurality of outer edges to a second portion of an outer edge of the plurality of outer edges. Thus, again, an advantage is that the protective material can help to minimize or reduce the risk of diseases transmitted by small animals, invertebrates, and other pests, and help to minimize or reduce exposure to poisons or toxins, by providing a physical barrier between the user and the harmful pests. Another advantage is that the protective suit may cover a large part of a user's body or the user's entire body such that exposure to pests or other harmful materials such as irritants or harmful plants or damaging materials can be reduced or eliminated. Another advantage is that the elasticity of the protective material may provide a degree of shock absorbance, thus reducing harm or discomfort to the user. Another advantage may be that the first net layer may provide the repellent suit with the appearance of typical or standard clothing as known in the art, which may improve the ease of use of the repellent suit to the user.

In another aspect, a repellent suit constructed from a protective material is provided, the suit comprising: a shirt portion having: a left sleeve; a right sleeve; a torso portion; a front shirt portion closure; and a pants portion having: a left leg; a right leg; a waist portion; and a front pants portion closure; a plurality of seams connecting the left sleeve, the right sleeve, and the front closure to the torso portion, and connecting the left leg, the right leg, and the front pants portion closure to the waist portion; bias tape at the plurality of seams; the protective material comprising a plurality of layers, the plurality of layers being breathable and being joined together via the bias tape, and the plurality of layers comprising: a first net layer; a second net layer; and a three-dimensional mesh layer between the first net layer and the second net layer, the three-dimensional mesh layer comprising a first mesh sheet and a second mesh sheet, and the first mesh sheet and the second mesh sheet being associated together via a plurality of compressible elements, and the second mesh sheet being raised to a first height above the first mesh sheet via the plurality of elastic elements; wherein the bias tape provided at each seam of the plurality of seams is sewn onto the first net layer, the three-dimensional mesh layer, and the second net layer. Thus, again, an advantage is that the protective material can help to minimize or reduce the risk of diseases transmitted by small animals, invertebrates, and other pests by providing a physical barrier between the user and the harmful pests. Another advantage is that the protective suit may cover a large part of a user's body such that exposure to pests or other harmful materials such as irritants or harmful plants can be reduced. Another advantage is that the elasticity of the protective material may provide a degree of shock absorbance, thus reducing harm or discomfort to the user. Another advantage may be that the thickness of the mesh layer may help to prevent any pests, plants, irritants, or other harmful objects from physically reaching the skin of the user. Another advantage may be that the first net layer may provide the repellent suit with the appearance of typical or standard clothing as known in the art, which may improve the ease of use of the repellent suit to the user.

In another aspect, a method of making a repellent suit constructed from a protective material is provided, the suit comprising: a shirt portion having: a left sleeve; a right sleeve; and a torso portion; a pants portion having: a left leg; a right leg; and a waist portion; a plurality of seams connecting the left sleeve, and the right sleeve to the torso portion, and connecting the left leg, and the right leg to the waist portion; bias tape at the plurality of seams; and thread sewing the bias tape to the plurality of seams; the protective material comprising: a plurality of layers; and a plurality of outer edges; the plurality of layers being breathable, and being joined together via the bias tape along the plurality of outer edges, and the plurality of layers comprising: a first net layer; a second net layer; and a three-dimensional mesh layer between the first net layer and the second net layer, the three-dimensional mesh layer comprising a first mesh sheet and a second mesh sheet raised to a first height above the first mesh sheet; wherein the first mesh sheet and the second mesh sheet are associated together via a plurality of compressible elements such that a force exerted on the second mesh sheet causes the second mesh sheet to be pressed towards the first mesh sheet at a second height smaller than the first height; wherein the bias tape provided at each seam of the plurality of seams is sewn onto the plurality of layers, such that the bias tape is bound to each layer of the plurality of layers via the thread passing through the bias tape and each layer of the plurality of layers, and such that the bias tape joins a first portion of an outer edge of the plurality of outer edges to a second portion of an outer edge of the plurality of outer edges; the method comprising the steps of: providing a pattern for construction of the shirt portion and the pants portion; providing the first net layer, the second net layer, and the three-dimensional mesh layer; stacking the three-dimensional mesh layer in between the first net layer and the second net layer; cutting the protective material into the pattern; aligning the first portion of the outer edge of the plurality of outer edges with the second portion of the outer edge of the plurality of outer edges; overlapping the bias tape with the first portion of the outer edge of the plurality of outer edges and with the second portion of the outer edge of the plurality of outer edges to create an overlapped layer section; seaming together the plurality of layers to the bias tape by inserting the thread into the bias tape and each layer of the plurality of layers along the overlapped layer section. Thus, again, an advantage is that the protective material can help to minimize or reduce the risk of diseases transmitted by small animals, invertebrates, and other pests, and help to minimize or reduce exposure to poisons or toxins, by providing a physical barrier between the user and the harmful pests. Another advantage is that the protective suit may cover a large part of a user's body or the user's entire body such that exposure to pests or other harmful materials such as irritants or harmful plants or damaging materials can be reduced or eliminated. Another advantage is that the elasticity of the protective material may provide a degree of shock absorbance, thus reducing harm or discomfort to the user. Another advantage may be that the first net layer may provide the repellent suit with the appearance of typical or standard clothing as known in the art, which may improve the ease of use of the repellent suit to the user.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
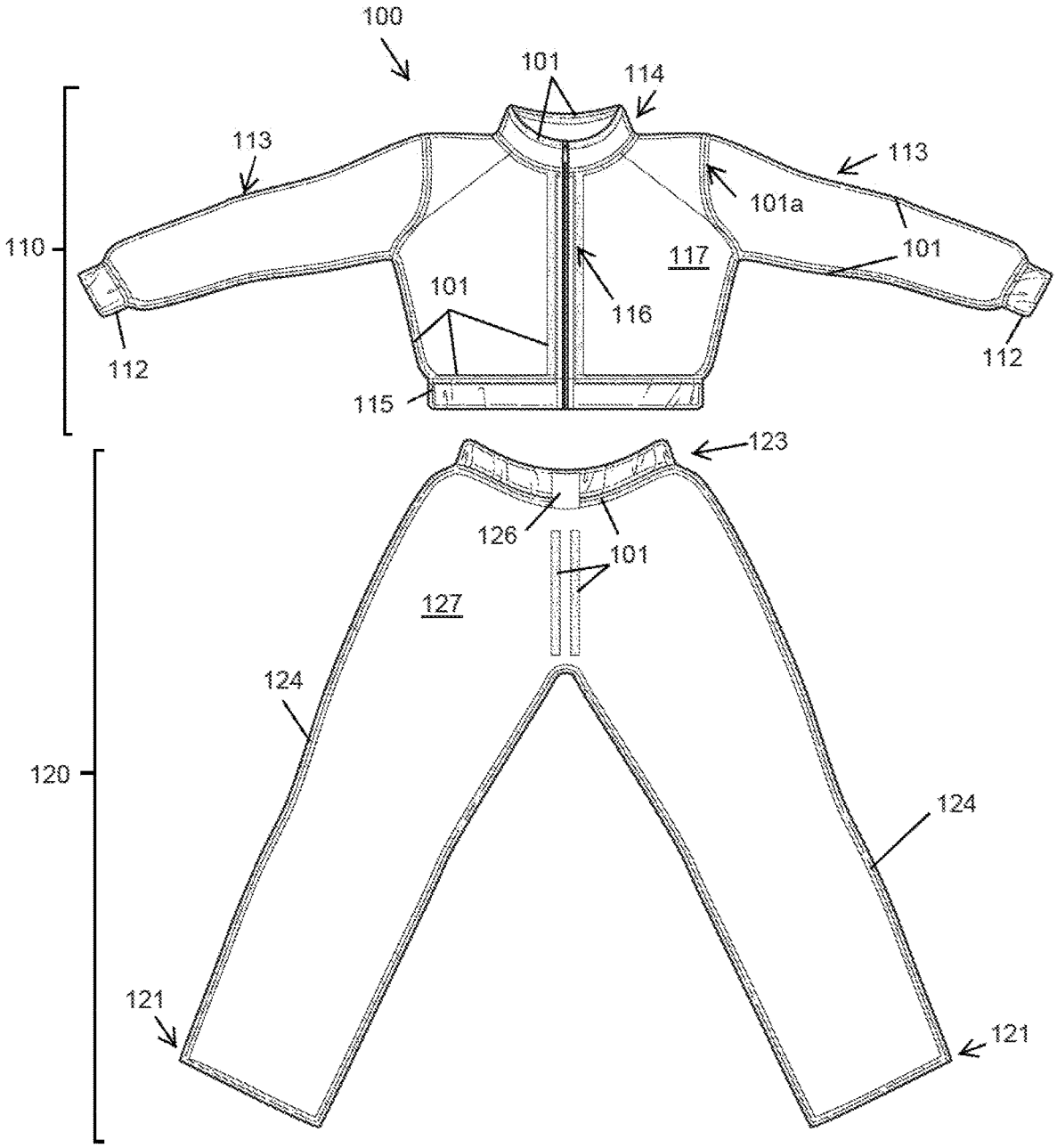
FIG. 1 illustrates a front view of a suit constructed from protective material, or a pest-repellent protective suit, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 401, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a front view of a suit constructed from protective material, or a pest-repellent protective suit ("pest-repellent suit," "repellent suit," "protective suit," or "suit") 100, according to an aspect. The suit, garment, apparel, or any other suitable similar wearable item constructed as described herein may be used for a protective, repelling barrier which may distance a user's skin from pests. As shown as an example, a protective suit 100 may be provided in multiple pieces, such as a shirt portion ("shirt portion," or "shirt") 110 and a pants portion ("pants portion" or "pants") 120. Other additional pieces may be provided, such as gloves, or a headpiece. It should be understood that the protective suit 100 may also be combined with other garments such as gloves, masks, boots, or head protection pieces as known in the art, or, for example, as may be required by a user's profession, hobby, or activity. It should be understood that the various pieces of the suit 100 may be provided in any suitable sizes and shapes.

Each piece of the suit 100 may be constructed from a protective material (as will be discussed in further detail when referring to FIG. 2), and bias tape, which may provide a physical barrier and distance between a user's skin and insects, small animals, or other pests. The protective suit 100 may thus protect a user from hazards and health risks such as small animal bites, stings, and also may help prevent the user's skin from making contact with parts of an animal or insect that could be an irritant, such as the proboscis, hair, and so on. The protective suit 100 may also prevent the user from making contact with harmful portions of plants, such as thorns or pointy branches, or poisonous leaves. The protective material may also provide some flame resistance to the user. Thus, the protective suit 100 may also protect the user from minor injuries such as scratches, abrasions, and burns in addition to providing a physical barrier between the user and disease-carrying pests.

The individual portions or pieces of the protective suit 100 may be separate from each other, as shown by the shirt portion 110 and pants portion 120 in FIG. 1. It should be noted that the protective suit 100 may also be provided as a single integral unit. When separate portions of a protective suit 100 are provided, the user may wear all the portions for maximum protection, such as by wearing both the shirt portion 110 and pants portion 120 of the protective suit 100. However, it should be noted that a user may wear either the shirt portion 110 or pants portion 120 individually, as with any other clothing item as is known in the art. The protective suit 100 may also be provided in similar styles to standard shirts and pants as known in the art and thus may be easy and efficient for the user to wear and remove. Each piece of the protective suit 100 may also be provided with the appearance of standard clothing, for example, with standard fabric on the exterior, which may, for example, be provided in any suitable color or pattern. Examples of fabrics that may be used may include cotton and linen. As an example, the protective suit 100 may be further covered by fabric such as fabric used for standard clothing. An advantage may be that the appearance of the protective suit 100 may be that of typical or standard clothing. Another advantage may be that the material used to construct the suit 100 may be light and similar to standard clothing, and thus may be easy for a user to pack and carry, The protective suit 100 may be constructed from a protective material (again, as will be described in further detail when referring to FIG. 2), which may help the protective suit 100 to be elastic, resilient, durable, and breathable. It should be understood that any suitable pattern for a garment may be provided and used for the construction of the protective suit 100, and the protective material may be cut into any suitable pattern for the making of the suit 100. As shown as an example, in addition to the protective material, a suit 100 may be equipped with certain features to provide a user with additional protection and comfort. The protective suit 100 may be provided with sleeves 113 (a left sleeve and a right sleeve), legs 124 (a left leg and a right leg), a collar 114, a bottom edge 115, and a torso portion 117. The shirt portion may also have a front closure 116, which may comprise a zipper or a Velcro fastener, for example. The bottom edge 115 may be elastic, which may help to prevent any irritants or pests from reaching the user's skin. Similarly, other cuffs or edges of the protective suit 100 may be provided with elastic, such as at the sleeve cuffs 112 and the waistband 123 of the pants 120, for example. Again, the elastic cuffs 112 or bands 123 may provide additional protection to the user by preventing insects from crawling into the suit 100, and thus create another barrier for the user. It should be understood that these areas may also be provided without elastic, such as at the pant leg cuff 121 shown as an example in FIG. 1. An advantage may be that this may provide better comfort to the user.

Zippers, buttons, tape, or any other suitable fastening means may be provided to the pieces of the protective suit 100 to allow a user to more easily put on or fasten the garments, such as at the front closure 116 of the shirt portion or the front closure 126 or the cuffs 121 of the pants portion, which, again, may comprise Velcro as an example, or any other suitable system, such as fastening means using elastic cords. It should be noted that the zippers may have small gaps between the teeth, which may be small enough to prevent small invertebrates or other pests from crawling into the garment and onto the skin of the user. Bias tape may be used to secure the zipper to the pants portion. Similarly, bias tape 101 may be provided at each seam of the plurality of seams of the suit 100, which may be used to connect the sleeves 113, collar 114, and front shirt portion closure 116 to the torso portion 117, and to connect the legs 124, the front pants portion closure 126 to the waist portion 127.

The protective material used for the construction of the suit may be seamed together using bias tape 101 (as will be further discussed when referring to FIG. 4), such as bias tape that is known in the art. The bias tape 101 may be provided at the seams and joints of the protective suit 100 as is shown in FIG. 1 as an example, which may help the suit to have better freedom of movement, elasticity, and flexibility, due to the stretchable properties of the bias tape 101. The bias tape 101 may bind together the layers of the protective material (shown in further detail in FIGS. 2 and 3) on the inner and outer joints of the clothing, such as, for example, where a sleeve is bound to the torso section of a jacket or shirt piece. This portion of bias tape is pointed to specifically as an example by 101*a*.

It should be understood that any protective suit 100 constructed using the protective material may be tailored or customized to fit users of a variety of shapes and sizes, and may also be provided in a variety of colors or patterns. It should also be understood that various types of clothing pieces may be constructed in a similar manner as the protective suit 100. The protective suit 100 may also be provided with any suitable number of pockets, straps, buckles, or other gear, such that other items or accessories can be carried or attached. As an example, the additional pockets or straps can allow the user to wear the protective suit 100 for various activities such as hunting, swimming, paintball, parachuting, and so on.

A suit 100 constructed as disclosed may allow a user to avoid harsh chemical repellents by providing the user with an alternative to harsh chemical repellents. Additionally, because the suit 100 may work by physically repelling small invertebrates without relying on chemical repellents, the suit 100 will continue to function underwater, while in the air, or while on the ground. It should be noted that a suit 100 may be provided in a variety or standard clothing sizes or custom tailored to fit a user.

Figure 2:
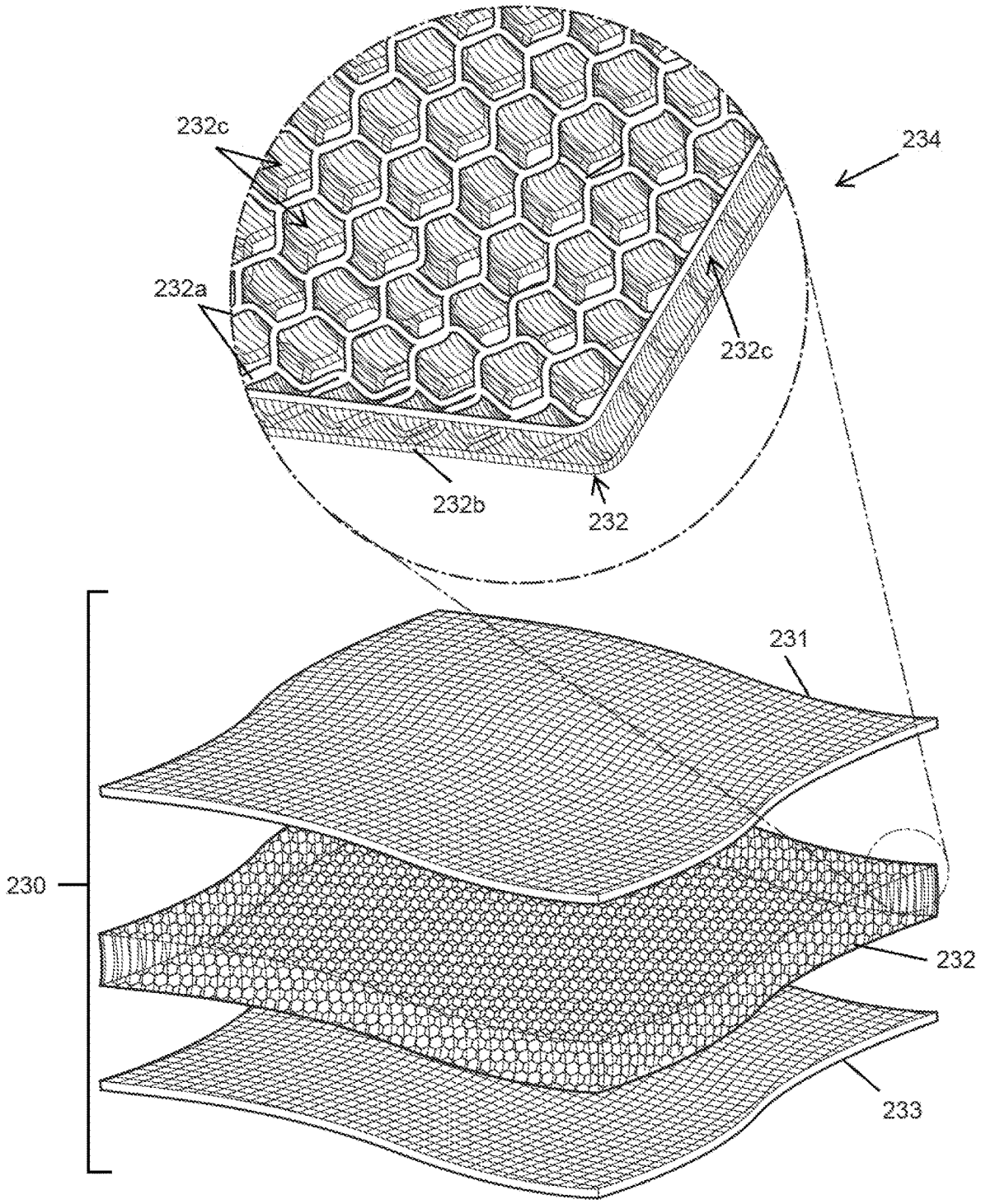
FIG. 2 illustrates an exploded perspective view of a layered protective material, with a detailed enlargement of a three-dimensional mesh layer, according to an aspect.

FIG. 2 illustrates an exploded perspective view of a layered protective material ("layered protective material," "protective material," or "repellent material") 230, with a detailed enlargement 234 of a three-dimensional mesh layer 232, according to an aspect. The protective material 230 may have three layers that may be sewn together, such as on edges as an example, or otherwise provided together to create a physical barrier between the user and disease-carrying vectors and other harmful elements. As is shown in further detail in FIGS. 3 and 4, the three layers of the protective material 230 may be stacked together in the order shown, then sewn or seamed together using bias tape and thread. When the plurality of layers of the protective material 230 are stacked together, each layer may be visible along the outer edges of the protective material 230. As another example, each layer may be substantially visible from a plurality of perspectives, due to the woven nature of the fabric, which may be provided with gaps within. Examples of the outer edge of the protective material are shown in further detail and in FIGS. 3 and 4. The three layers of the protective material may thus provide a physical barrier to protect the user from insects that carry harmful illnesses (such as Zika, malaria, Dengue fever, and so on). As an example, the entirety of the protective suit (as shown by 100 in FIG. 1) may be constructed from the layered "3D woven mesh," or "mesh layer") 232, and a comfort fabric layer ("comfort fabric layer," "second net layer," "inner fabric layer," "internal fabric layer," or "fabric layer") 233. It should be understood that the mesh or netting shown as an examples for the first net layer 231 and the second net layer 233 is enlarged for visual clarity, and it should be understood that the protective material layers may be provided with a fine mesh or netting having holes small enough to prevent insects from passing through. It should be understood that the 3D mesh layer 232 may also have mesh that is small enough to prevent most types of insects and other pests from passing through the holes.

Figure 3:
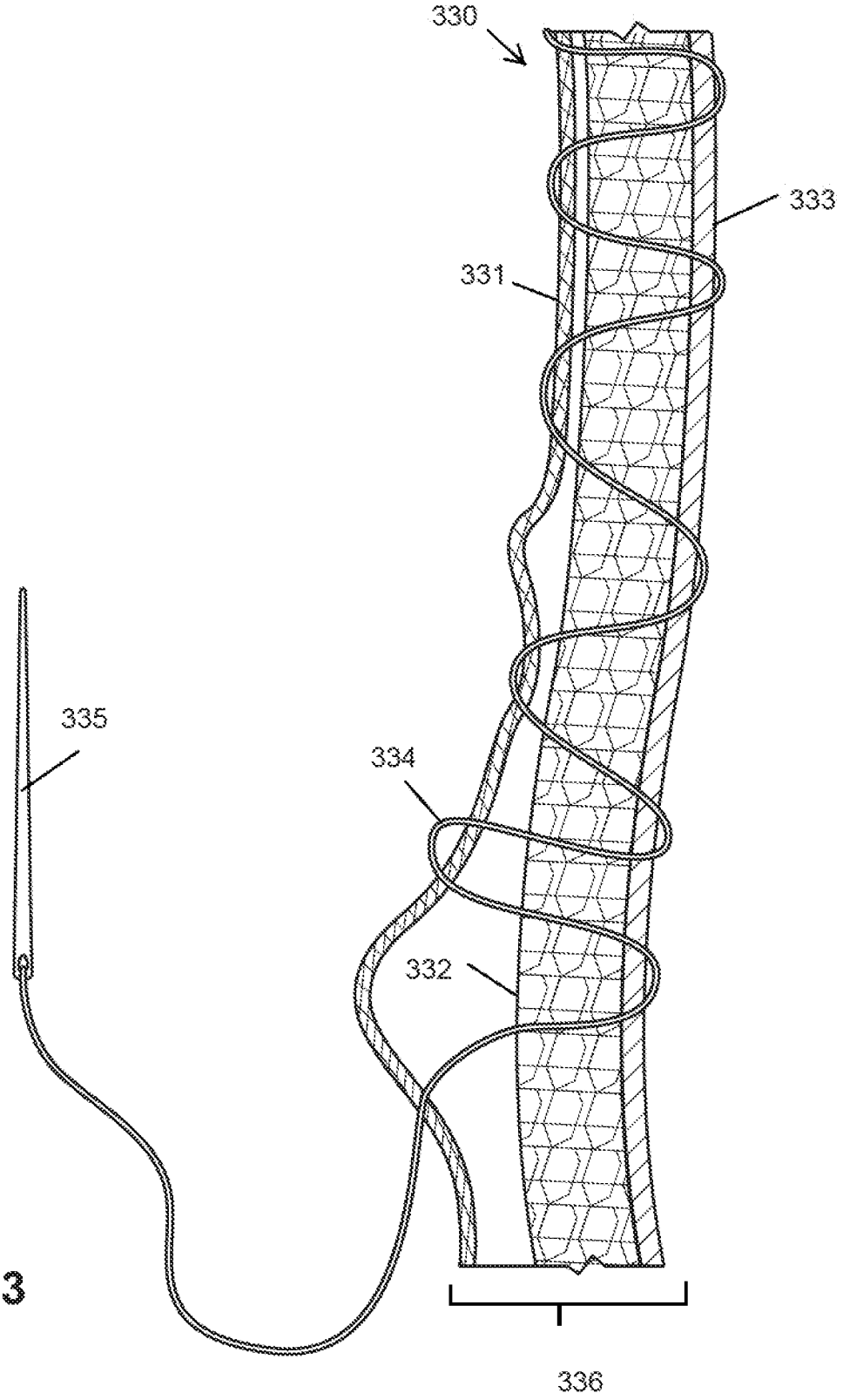
FIG. 3 illustrates a side sectional view of the protective material, showing the outer edge of the protective material, according to an aspect.

Again, the three layers of the protective material 230 may be joined, sewn, or seamed together in any suitable fashion, such as in the example depicted in FIG. 3. The 3D mesh 232 may be woven or knitted, and may be elastic, and breathable, and resilient such that when a force is applied and next removed from the 3D mesh, the 3D mesh may return to its original or natural shape. The 3D mesh may have a first mesh sheet 232*a*, which may be on the external-facing side ("first side," or "first surface,") of the protective material 230, and may have a second mesh sheet 232*b*, which may be on a second internal-facing side ("second side," or "second surface,"). The first mesh sheet 232*a* and the second mesh sheet 232*b* may be associated together with a plurality of compressible elements 232*c*. Both the first side and the second side of the 3D mesh 232 may be covered with a net layer. Thus, a protective material may be created by a layer of 3D air mesh 232 as known in the art, covered on each surface, which may be the exterior and the interior, by a net layer. On the external first side may be a first net layer, and on the internal second side, which may be worn against the user's skin, may be a second net layer. As an example, each of the net layers (first net layer and second net layer) may be constructed from the same material. It should be understood that the materials used for the construction of the first net layer 231 and the second net layer 233 may be different according to a user's needs.

The net layer ("first net layer" or "external net layer") 231 may be the outermost layer when the protective material is used to construct a suit or other clothing item. The net layer 231 may be thin, flexible, elastic, and impermeable to small animals and invertebrates, and thus, insects and other pests may be prevented from passing through the net layer 231. The net layer 231 may be constructed from any suitable elastic net material. The provided holes in the net layer 231 may be approximately 0.08 mm-1 mm, which may be sufficiently large enough to provide air ventilation to a user while being small enough to prevent pests from crawling through and reaching the skin of the user.

The 3D mesh layer 232 may be the middle layer of the three layers of the protective material 230. The 3D mesh layer may provide an additional barrier against insects and other pests, such that they do not come into contact with the user's skin. The mesh layer 232 can provide a secondary defense against pests, but may also serve as a first line of defense should any damage occur to the net layer 231, for example. As shown in the detailed enlargement 234 of a portion of the 3D mesh layer 232, the mesh layer 232 may be raised and have a rounded or three-dimensional shape and thickness created, again, by having two mesh sheets 232*a* and 232*b*, which may comprise wire, and the mesh sheets may be connected by wire fibers, filaments, or any other suitable plurality of compressible elements 232*c* to interweave the two mesh sheets, as is known in the art. Thus, when the protective material 230 is worn by a user by, for example, being constructed into a protective suit (shown by 100 in FIG. 1), the physical barriers created by the protective material 230 may be created. The first mesh sheet 232*a* may be raised to a first height above the second mesh sheet 232*b*, due to the biasing of the compressible elements 232*c* holding the first mesh sheet 232*a*. Thus, the first mesh sheet 232*a* may be raised to a first height above the user's skin when the protective material is 230 is worn. The 3D mesh layer 232 may provide shock absorbance to the protective material, and also elasticity. For example, when a force is applied to the first mesh sheet 232*a*, the first mesh sheet 232*a* may be pushed down to a second height, which is closer to the second mesh sheet 232*b* than the first height. When the force is removed, the second mesh sheet 232*a* may be biased to return to the first height. As another example, the mesh sheets may each be capable of returning to a natural or original shape after being bent into a second or different shape.

The thickness of the 3D mesh layer 232, which may be determined by the first height of the first mesh sheet 232*a* raised above the second mesh sheet 232*b*, may be provided such that any insect resting on top of the mesh layer is raised too high above the user to be able to reach the skin of the user. Thus, the thickness and shape of the mesh layer 232 may help to prevent insect bites. The thickness of the mesh layer 232 can also improve breathability of the protective material 230, by raising the distance between the layers of the protective material and promoting air circulation. The plurality of compressible elements 232*c* between each mesh sheet may provide flexibility, elasticity, and shock absorbing properties to the protective suit, for example.

Each component of the mesh layer 232 may also be constructed to be elastic, resilient, and flexible, which may also help to provide shock absorbent properties to the protective material 230. The elasticity and resilience of the mesh layer 232 may help the mesh layer 232 to maintain its shape. The mesh layer 232 may as an example show the Poisson effect, by collapsing when compressed, and may recover to its natural state, shape or form after the compression is removed. As an example, the 3D mesh 232 may be constructed from polyethylene, or any other suitable materials.

Finally, the innermost layer may be a comfort fabric layer ("comfort fabric layer," or "second net layer") 233, for example. The inner fabric layer 233 may provide comfort to the user. prevent a wearer's skin from becoming irritated from continuously rubbing against the mesh layer 232. The comfort fabric net layer may be breathable, thus keeping a user cool. It should be understood that the comfort fabric layer 233 may be constructed from the same material as the net layer 231 and thus may be a second net layer 233.

Thus, a three-layered protective material 230 may provide a user with multiple layers of protection against harmful infections, poisoning, and/or diseases transmitted via small invertebrates and against small cuts and/or abrasions caused by plants or rocks, and so on. Additionally, the three-layer construction disclosed above may have the additional benefit of more easily circulating air. Thus, a protective suit (shown by 100 in FIG. 1) may help a user to stay cool in hot climates, or help a user to stay dry in humid climates. It should be noted that a protective material 230 with fewer or more than three layers may be used to construct a protective suit. For example, if a user lives in an area that has a cold climate at times, such as in a desert environment at nighttime, a fourth insulating layer may be provided to assist a user in keeping warm.

FIG. 3 illustrates a side sectional view of the protective material 330, showing the outer edge 336 of the protective material 330, according to an aspect. As disclosed above, a protective material 330 may have three layers: a net layer 331, a mesh layer 332, which may be woven or knitted, and a comfort fabric layer 333. The three layers may be held together with thread 334 and bias tape (as shown by 401*b* in FIG. 4). As is known to those of ordinary skill in the art, the thread 334 may be stitched through the three layers, such as by using a needle 335, and the bias tape (shown by 401 in FIG. 4) such that the protective material 330 is flexible and stretchable. Any appropriate type of thread may be sued to assemble the three layers of the protective material. As an example, cotton thread, elastic thread, or synthetic thread may be used. Machine sewing or knitting may be used for the seaming, or, as another example, a needle 335 may be to used with the thread 334 to achieve the seaming. It should be noted that other appropriate methods, such as machine sewing, may be used to assemble the three layers of the protective material.

Additionally, the assembly method disclosed hereinabove (loose stitch and thread method) may be used at the seams of the suit. In other words, a loose stitch may be used to attach the different components of the shirt portion and pants portion of the protective suit with bias tape at the seams. Thus, the suit may be flexible and allow a user a larger range of motion.

It should be understood that the three layers of the protective material 330 may be joined, sewn or seamed together only on the bias of the fabric. An advantage is that, should the fabrics be joined in another manner, the protective material 330 may become compressed, which may cause the repellent properties of the material to be reduced; thus, joining on the bias preserves the repellent properties of the material 330. Another advantage is that flexibility of the three layers is also preserved to help prevent damage to the user such as from scratches from branches, and so on, by only joining the fabrics on the bias. It should also be understood that any suitable method of sewing or seaming may be used to attach pockets, straps, buckles, or other similar gear or additions to the suit.

Figure 4:
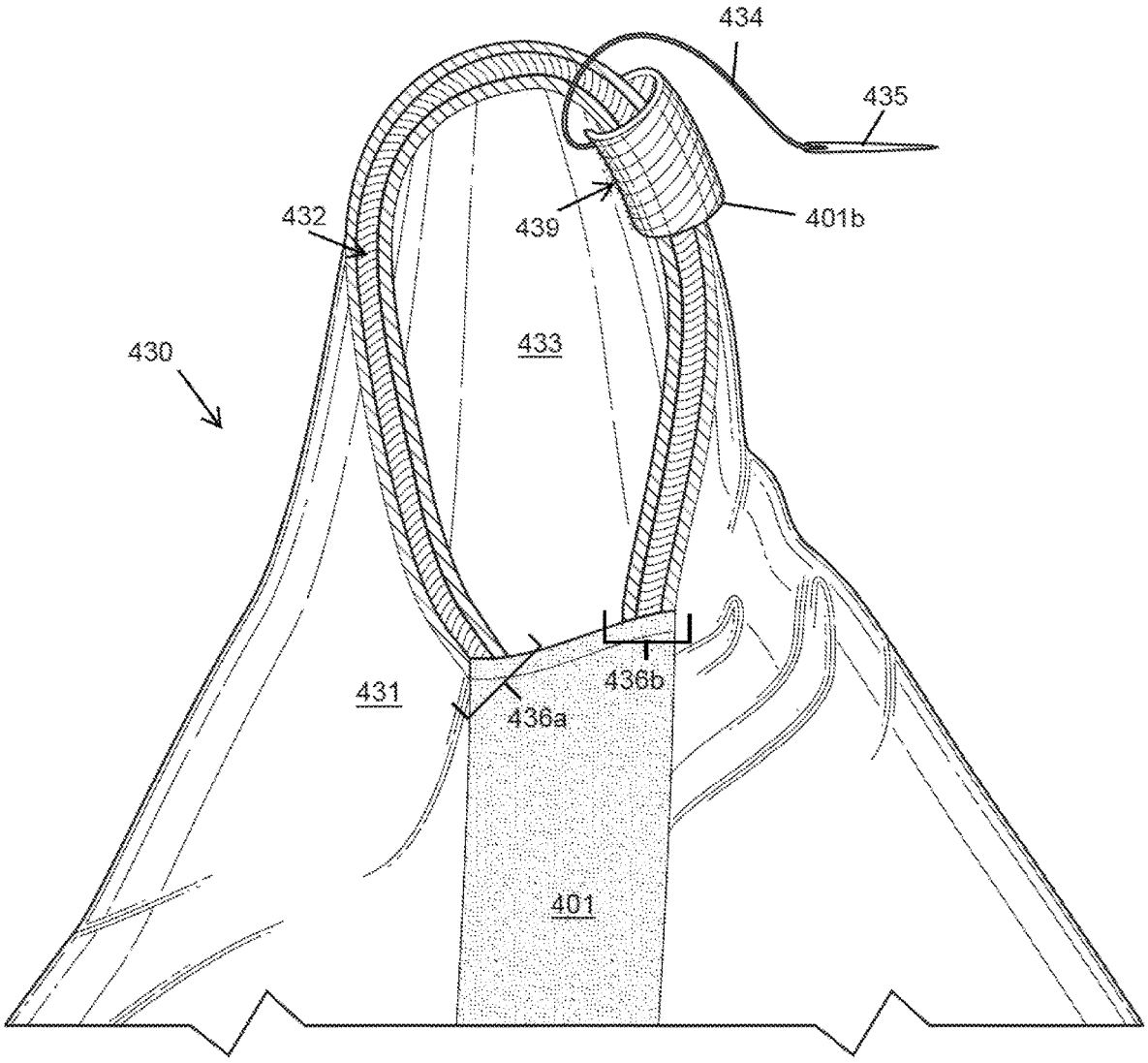
FIG. 4 illustrates the perspective view of the protective material seamed together along portions of its outer edge using bias tape 401, according to an aspect.

FIG. 4 illustrates the perspective view of the protective material 430 seamed together along portions of its outer edge using bias tape 401, according to an aspect. In order to create the shape of a protective suit (as shown by 100 in FIG. 1) or any other item to be used as a physical, protective barrier between pests and a user, the protective material 430 may be cut and sewn into a desired or predetermined shape or pattern. The outer edge of the protective material (as shown by 336 in FIG. 3) may be joined to the outer edge of another piece of protective material, as an example. As shown in FIG. 4 as another example, a first portion of an outer edge 436*a* of a protective material 430 may be joined to a second portion of an outer edge 436*b* of the same protective material 430. The joining or seaming together may be done by using bias tape 401, and the bias tape 401 may be attached to the plurality of layers of the protective material 430 (shown by the first net layer 431, mesh layer 432, and the second net layer 433). Again as previously discussed, as an example, bias tape, shown by 401*b*, may be stitched around the three layers. The stitches created by the thread 434 are shown by 439 as an example, such that the bias tape 401*b* encloses the plurality of layers, such as the portions of the outer edge represented by 436*a* and 436*b*. Edges that are not connected with any other portions of the suit may be covered in this manner, for example. It should be understood that the perspective view shown in FIG. 4, wherein the outer edge of the protective material is visible, may be covered in bias tape entirely, and is shown in FIG. 4 only partially covered with bias tape 401*b* for visual clarity such that the layers may be visible. The collar, shown by 114 in FIG. 1, may be constructed in this manner as an example.

It should be understood that portions of the outer edge 436*a* and 436*b* may be seamed with the bias tape 401, or all outer edges of the protective material 430 may be seamed with the bias tape 401. Again as an example, all outer edges of the protective material 430 may be seamed up using the bias tape 401 such that the mesh layer 432 is enclosed by the first net layer 431, the second net layer 433, and the bias tape 401 and 401*b*. In order to seam the outer edges of the protective material, the bias tape 401 may overlap all of the outer edges that are to be seamed together, such as the portions of the outer edge represented by 436*a* and 436*b*. This may create overlapped layer sections, as can be seen in FIG. 4 as an example. Next, the seams of the protective suit may be created by inserting the thread into all layers of the plurality of layers and the bias tape along the overlapped layer sections. This may be performed according to any suitable garment pattern or any other garment making method, for example. Other steps may follow in order to make the protective or repellent suit, such as by adding a front closure to the shirt portion or the pants portion, and adding zippers or pockets.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A repellent suit constructed from a protective material, the repellent suit comprising:

a shirt portion having:
- a left sleeve;
- a right sleeve;
- a collar;
- a torso portion; and
- a front shirt portion closure;

a pants portion having:
- a left leg;
- a right leg;
- a waist portion; and
- a front pants portion closure;

a plurality of seams connecting the left sleeve, the right sleeve, the collar, and the front closure to the torso portion, and connecting the left leg, the right leg, and the front pants portion closure to the waist portion;

bias tape at the plurality of seams; and thread sewing the bias tape to the plurality of seams;

the protective material comprising:
- a plurality of layers; and
- a plurality of outer edges;

the plurality of layers being breathable, and being joined together via the bias tape along the plurality of outer edges, and the plurality of layers comprising:

a first net layer;

a second net layer; and a three-dimensional mesh layer between the first net layer and the second net layer, the three-dimensional mesh layer comprising a first mesh sheet and a second mesh sheet raised to a first height above the first mesh sheet;

wherein the first mesh sheet and the second mesh sheet are associated together via a plurality of compressible elements such that a force exerted on the second mesh sheet causes the second mesh sheet to be pressed towards the first mesh sheet at a second height smaller than the first height;

wherein the plurality of seams occur on biases of each layer of the plurality of layers;

wherein the bias tape provided at each seam of the plurality of seams is sewn onto the plurality of layers, such that the bias tape is bound to each layer of the plurality of layers via the thread passing through the bias tape and each layer of the plurality of layers, and such that the bias tape joins a first portion of an outer edge of the plurality of outer edges to a second portion of an outer edge of the plurality of outer edges.

2. The repellent suit of claim 1, wherein the three-dimensional mesh layer is enclosed by the first net layer, the second net layer, and the bias tape.

3. The repellent suit of claim 1, the left sleeve and the right sleeve each further comprising an elastic cuff.

4. The repellent suit of claim 1, wherein the front closure comprises a zipper.

5. The repellent suit of claim 1, wherein the shirt portion is integral to the pants portion.

6. The repellent suit of claim 1, wherein the shirt portion is separate from the pants portion.

7. The repellent suit of claim 6, the pants portion further comprising an elastic waistband.

8. The repellent suit of claim 6, the shirt portion further comprising an elastic bottom edge.

9. A repellent suit constructed from a protective material, the repellent suit comprising:

a shirt portion having:

a left sleeve;

a right sleeve;

a torso portion;

a front shirt portion closure; and a pants portion having:

a left leg;

a right leg;

a waist portion; and a front pants portion closure;

a plurality of seams connecting the left sleeve, the right sleeve, and the front closure to the torso portion, and connecting the left leg, the right leg, and the front pants portion closure to the waist portion;

bias tape at the plurality of seams;

the protective material comprising a plurality of layers, the plurality of layers being breathable and being joined together via the bias tape, and the plurality of layers comprising:

a first net layer;

a second net layer; and a three-dimensional mesh layer between the first net layer and the second net layer, the three-dimensional mesh layer comprising a first mesh sheet and a second mesh sheet, and the first mesh sheet and the second mesh sheet being associated together via a plurality of compressible elements, and the second mesh sheet being raised to a first height above the first mesh sheet via the plurality of compressible elements;

wherein the bias tape provided at each seam of the plurality of seams is sewn onto the first net layer, the three-dimensional mesh layer, and the second net layer.

10. The repellent suit of claim 9, wherein the three-dimensional mesh layer is enclosed by the first net layer, the second net layer, and the bias tape.

11. The repellent suit of claim 9, the left sleeve and the right sleeve each further comprising an elastic cuff.

12. The repellent suit of claim 9, wherein the front closure comprises a zipper.

13. The repellent suit of claim 9, wherein the shirt portion is integral to the pants portion.

14. The repellent suit of claim 9, wherein the shirt portion is separate from the pants portion.

15. The repellent suit of claim 14, the pants portion further comprising an elastic waistband.

16. The repellent suit of claim 14, the shirt portion further comprising an elastic bottom edge.

17. A method of making a repellent suit constructed from a protective material, the repellent suit comprising: a shirt portion having:

a left sleeve;

a right sleeve; and a torso portion;

a pants portion having:

a left leg;

a right leg; and a waist portion;

a plurality of seams connecting the left sleeve, and the right sleeve to the torso portion, and connecting the left leg, and the right leg to the waist portion;

bias tape at the plurality of seams; and thread sewing the bias tape to the plurality of seams;

the protective material comprising:

a plurality of layers; and a plurality of outer edges;

the plurality of layers being breathable, and being joined together via the bias tape along the plurality of outer edges, and the plurality of layers comprising:

a first net layer;

a second net layer; and a three-dimensional mesh layer between the first net layer and the second net layer, the three-dimensional mesh layer comprising a first mesh sheet and a second mesh sheet raised to a first height above the first mesh sheet;

wherein the first mesh sheet and the second mesh sheet are associated together via a plurality of compressible elements such that a force exerted on the second mesh sheet causes the second mesh sheet to be pressed towards the first mesh sheet at a second height smaller than the first height;

wherein the bias tape provided at each seam of the plurality of seams is sewn onto the plurality of layers, such that the bias tape is bound to each layer of the plurality of layers via the thread passing through the bias tape and each layer of the plurality of layers, and such that the bias tape joins a first portion of an outer edge of the plurality of outer edges to a second portion of an outer edge of the plurality of outer edges;

the method comprising the steps of:

providing a pattern for construction of the shirt portion and the pants portion;

providing the first net layer, the second net layer, and the three-dimensional mesh layer;

stacking the three-dimensional mesh layer in between the first net layer and the second net layer;

cutting the protective material into the pattern;

aligning the first portion of the outer edge of the plurality of outer edges with the second portion of the outer edge of the plurality of outer edges;

overlapping the bias tape with the first portion of the outer edge of the plurality of outer edges and with the second portion of the outer edge of the plurality of outer edges to create an overlapped layer section;

seaming together the plurality of layers to the bias tape by inserting the thread into the bias tape and each layer of the plurality of layers along the overlapped layer section.

18. The method of claim 17, wherein the three-dimensional mesh layer is enclosed by the first net layer, the second net layer, and the bias tape.

19. The method of claim 17, the shirt portion further comprising a front shirt portion closure.

20. The method of claim 19, further comprising the step of:

attaching a zipper to the front shirt portion closure.

* * * * *